US006628789B1

(12) United States Patent
Colby

(10) Patent No.: US 6,628,789 B1
(45) Date of Patent: Sep. 30, 2003

(54) TALKING TOILET PAPER HOLDER

(76) Inventor: Charles "Russ" Colby, 14003 Palawan Way #111, Marina del Ray, CA (US) 90292

( * ) Notice: Subject to any disclaimer, the term of this patent is extended or adjusted under 35 U.S.C. 154(b) by 0 days.

(21) Appl. No.: 09/406,412

(22) Filed: Sep. 27, 1999

(51) Int. Cl.[7] ..... H04B 5/00
(52) U.S. Cl. ..... 381/79; 381/124; 242/599
(58) Field of Search ..... 700/94; 381/77, 381/87, 124, 79; 242/599, 596.7, 594.3, 598.5, 598.3

(56) References Cited

U.S. PATENT DOCUMENTS 5,241,427 A * 8/1993 Lin ..... 704/272
5,690,495 A * 11/1997 Collier ..... 242/594.3
6,000,658 A * 12/1999 McCall, Jr. ..... 242/564.2

FOREIGN PATENT DOCUMENTS

FR BE 1006743 A6 * 11/1994

* cited by examiner

*Primary Examiner*—Ping Lee

(57) ABSTRACT

Talking toilet paper holder with a hollow toilet paper holding spindle having closed ends, one said end having a compressable spring mounted shaft capable of inserting into a standard toilet paper roll holder, the opposite the end having a fixed shaft member extending from the opposite ends' center capable of inserting into the opposite end of a standard toilet paper roll holder. An electronic digital recording and playback mechanism housed within said paper holding spindle is activated by a record button flush with the surface of said hollow spindle. A power source such as a plurality of batteries are contained within said hollow spindle. A speaker is mounted flush with the inside wall of said opposite end of said spindle. A plurality of apertures in said opposite end enables a voice message to emit from said speaker through said end wall to the outer environment. A motion sensing switch and associated electronics causes a recorded message to play when said toilet paper holder is turned or otherwise moved.

1 Claim, 2 Drawing Sheets

TALKING TOILET PAPER HOLDER

BACKGROUND OF THE INVENTION

This invention relates generally to the field of toilet paper holders, and more particularly to a talking toilet paper holder.

In developed countries, the use of toilet paper is an accepted medium for the act of wiping ones anus after moving ones bowels.

To this end, most homes have toilet paper dispensing devices normally consisting of a pair of opposed arms each having a recess capable of holding a spring loaded spindle. Toilet paper commonly comes in roll form mounted on a hollow cardboard core. The user inserts the spindle into the core and inserts the spindle between the opposed arms of the roll holder that is commonly mounted on the bathroom wall in a convenient location.

Although the current toilet paper holding design of a spring loaded spindle and opposed arms to hold a roll of toilet paper is effective, the process of dispensing toilet paper can be made more informative, enjoyable and novel by having a pre-recorded message play when one begins the dispensing process. The message can be of a serious nature such as reminding a person to wash hands after use or reminding a person not to flush bulky items such as tampons or the like. The message can also be of a humerous nature such as asking the person to be ecologically conscious and use both sides of the toilet paper.

SUMMARY OF THE INVENTION

The primary object of the invention is to provide a novel toilet paper holder that emits a digital voice message when toilet paper is dispensed.

Other objects and advantages of the present invention will become apparent from the following descriptions, taken in connection with the accompanying drawings, wherein, by way of illustration and example, an embodiment of the present invention is disclosed.

Talking toilet paper holder comprising: A hollow toilet paper holding spindle having closed ends, one said end having a compressable spring mounting shaft capable of inserting into a standard toilet paper roll holder, the opposite said end having a fixed shaft member extending from said opposite ends' center capable of inserting into the opposite end of said standard toilet paper roll holder; an electronic digital recording and playback mechanism housed within said paper holding spindle; a record button and battery door flush with the surface of said hollow spindle, a power source such as a plurality of batteries contained within said hollow spindle, and a speaker mounted flush with the inside wall of said opposite flat end of said spindle. A plurality of apertures in said opposite end enables a voice message to emit from said speaker through said end wall to the outer environment. A motion sensing switch and associated electronics causes a recorded message to play when said toilet paper holder is turned or otherwise moved.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
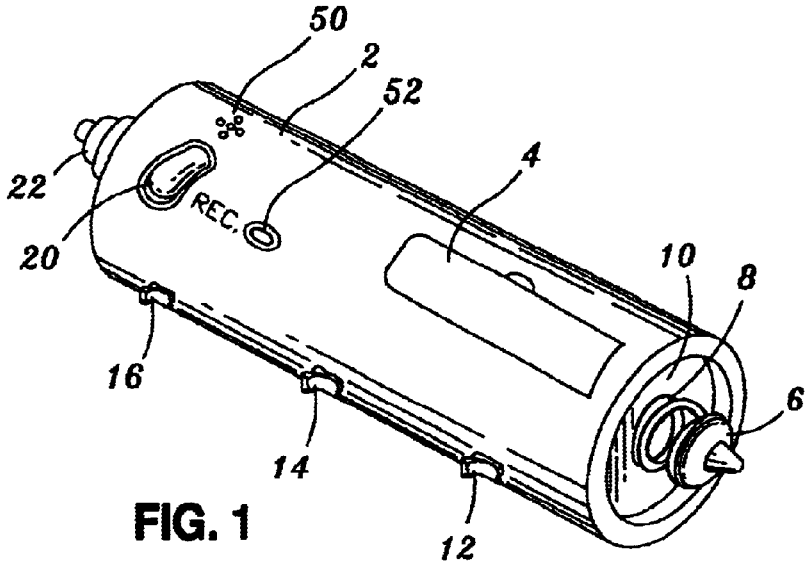
FIG. 1 is a perspective view of the toilet paper holder of the present invention
Figure 2:
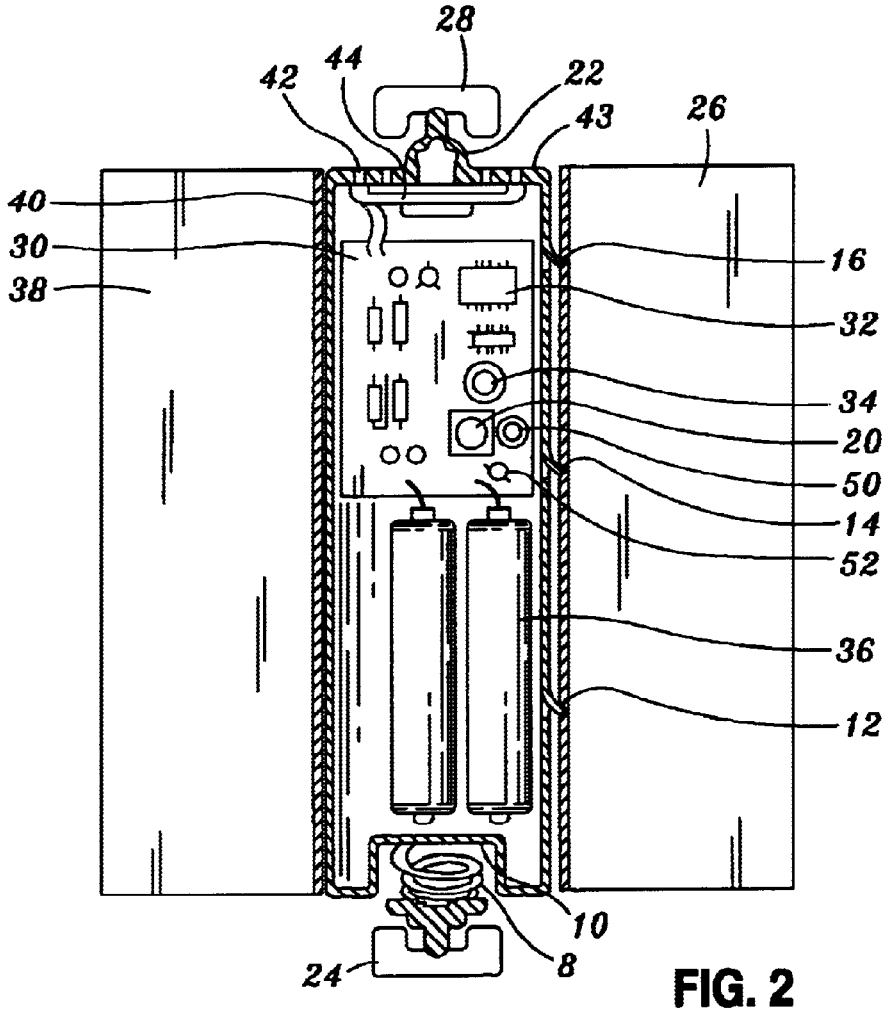
FIG. 2 is a side section view of the toilet paper holder of the present invention.
Figure 3:
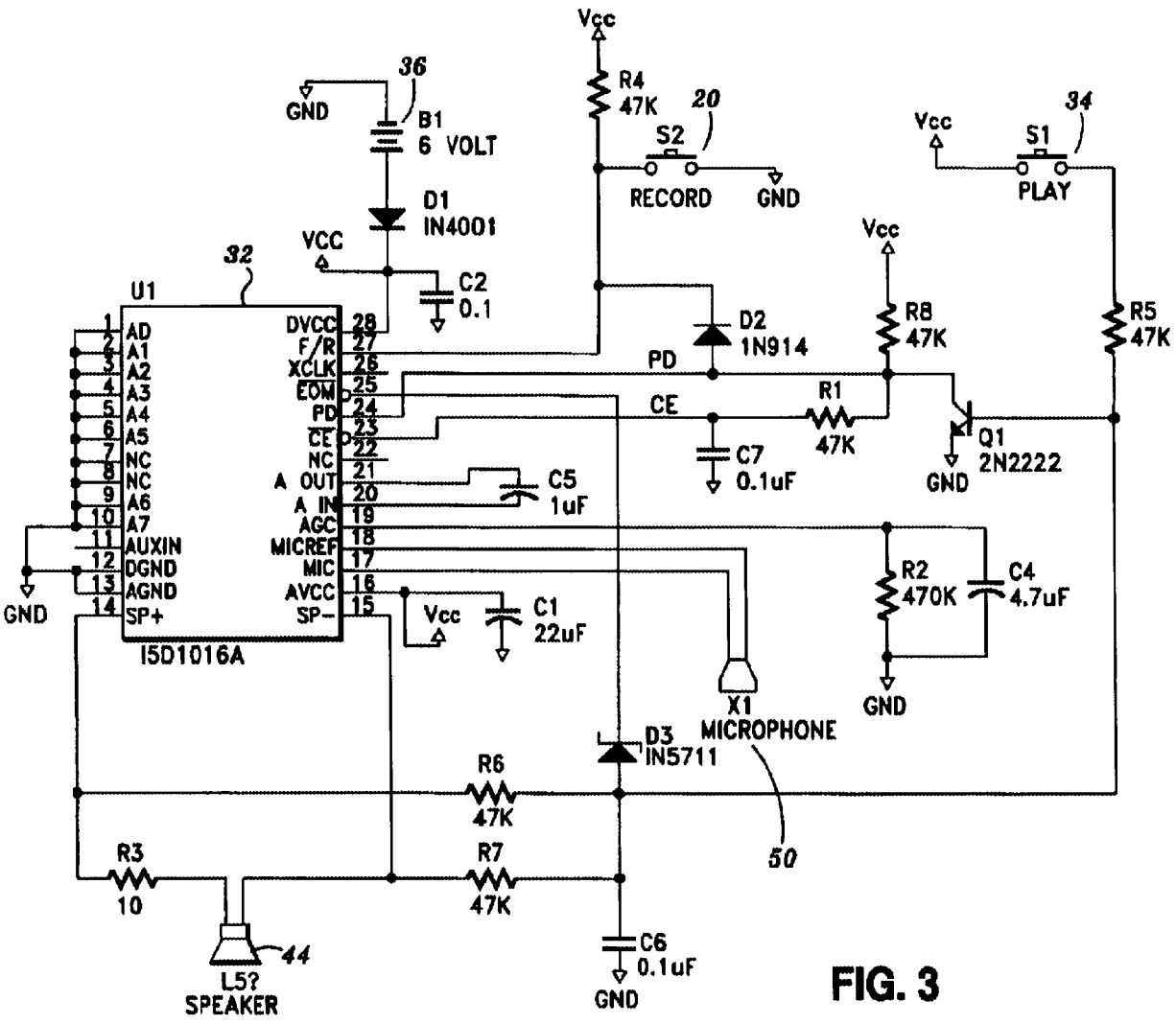
FIG. 3 is a schematic diagram of the electronic portion of the present invention.

Referring now to FIG. 1 we see a perspective view of the toilet paper holder of the present invention. Spindle 2 is hollow and made of rigid molded plastic such as ABS. One end of spindle 2 is recessed 10 and has a compression spring 8 terminating in a small shaft 6 emanating from its center. The opposite end of spindle 2 has a fixed shaft 22. The spindle 2 is essentially cylindrical and has a flush mounted record button 20, LED 52, microphone opening 50 and battery door 4 arranged on the surface of the cylinder 2. A plurality of integral barbs 12, 14, 16 extend from the surface of the cylinder 2 so that when a toilet paper roll is slid onto the cylinder 2 the barbs imping on the inner surface of the toilet paper roll so that when the roll turns, the spindle 2 turns along with it. To make a voice recording the user presses record button 20 and speaks his or her message into microphone 50. LED 52 lights up while the recording is in process. The light 52 turns off at the end of the recording process. At typical time for a digital recording is ten seconds. FIG. 2 shows a side section of the present invention as it is in place in a holding bracket 24, 28 which can be found in most bathrooms. Toilet paper roll 38 is in place on spindle 2. Batteries 36 power electronic circuit 40 consisting of a digital record and playback chip 32 and associated electronics that are commonly known for amplification of sound through a speaker 44. A plurality of apertures 42 in end wall 43 allow sound from the speaker 44 to radiate out into the local environment. Tilt switch 50 is activated when the user pulls on the toilet paper roll 38 causing spindle 2 to rotate. Switch 50 can be a mercury switch or the like so that when tilted it completes a circuit. The completion of the circuit causes a pre-recorded message to play once and then stop. FIG. 3 is a schematic diagram of the electrical circuit of the present invention.

In the above described and illustrated way, a user can easily record a message into the toilet paper roll holder so that when a person pulls a paper from the roll the message will play.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. Talking toilet paper holder comprising:

a hollow toilet paper holding spindle having closed ends, one said end having a compressible spring mounting shaft capable of inserting into a standard toilet paper roll holder, the opposite said end having a fixed shaft member extending from said opposite end's center capable of inserting into the opposite end of said standard toilet paper roll holder;

an electronic digital recording and playback mechanism housed within said paper holding spindle;

a record button, an on-off switch, and a battery door flush with the surface of said hollow spindle;

a power source comprising a plurality of batteries contained within said hollow spindle;

a speaker mounted flush with the inside wall of said opposite end of said spindle;

a plurality of apertures in said opposite end enabling a voice message to emit from said speaker through said end wall to the outer environment;

a motion sensing switch and associated electronics that causes a recorded message to play when said toilet paper holder is turned or moved.

* * * * *